US011675288B2

(12) United States Patent
Sato et al.

(10) Patent No.: US 11,675,288 B2
(45) Date of Patent: Jun. 13, 2023

(54) IMAGE FORMING APPARATUS

(71) Applicant: CANON KABUSHIKI KAISHA, Tokyo (JP)

(72) Inventors: Taichi Sato, Kanagawa (JP); Takashi Mukai, Kanagawa (JP); Yasukazu Ikami, Tokyo (JP); Shuhei Tokiwa, Tokyo (JP); Fuka Enokido, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/696,672

(22) Filed: Mar. 16, 2022

(65) Prior Publication Data

US 2022/0326634 A1 Oct. 13, 2022

(30) Foreign Application Priority Data

Apr. 7, 2021 (JP) ..... JP2021-065418

(51) Int. Cl.
*G03G 15/06* (2006.01)

(52) U.S. Cl.
CPC ..... *G03G 15/065* (2013.01)

(58) Field of Classification Search
CPC ..... G03G 15/00; G03G 15/06; G03G 15/065
USPC ..... 399/38, 55
See application file for complete search history.

(56) References Cited

U.S. PATENT DOCUMENTS

| | | | | |
|---|---|---|---|---|
| 6,459,872 | B1 * | 10/2002 | Komiya | G03G 21/0064 399/150 |
| 8,428,477 | B2 | 4/2013 | Shibata | |
| 9,958,805 | B2 * | 5/2018 | Matsushita | G03G 15/0812 |
| 10,509,344 | B2 * | 12/2019 | Kimura | G03G 15/045 |
| 2021/0373454 | A1 * | 12/2021 | Tetsuno | G03G 15/065 |

FOREIGN PATENT DOCUMENTS

| | | | |
|---|---|---|---|
| JP | 2004191766 | A | 7/2004 |
| JP | 2009237465 | A | 10/2009 |
| JP | 2011013663 | A | 1/2011 |
| JP | 2011145449 | A | 7/2011 |

* cited by examiner

*Primary Examiner* — Hoan H Tran
(74) *Attorney, Agent, or Firm* — Rossi, Kimms & McDowell LLP

(57) ABSTRACT

An image forming apparatus includes an image bearing member, a developing member that supplies a developer of a regular polarity, a developer supply member that supplies developer to the developing member, and a control unit that applies a first voltage to the developing member and a second voltage to the developer supply member. The control unit executes an image forming operation, and a rotational operation in which the developer supply member rotates in a state in which the first voltage of a regular polarity is applied thereto. The rotational operation includes a first rotational operation in which a potential difference is a first potential difference and a second rotational operation in which the developing member and the developer supply member rotate in a state in which the second voltage having the same polarity as the regular polarity and having a greater absolute value is applied.

19 Claims, 5 Drawing Sheets

IMAGE FORMING APPARATUS

BACKGROUND OF THE INVENTION

Field of the Invention

The present invention relates to an image forming apparatus.

Description of the Related Art

Conventionally, when performing image forming with an image forming apparatus according to an electrophotographic system, a charging member uniformly charges the surface of a photosensitive drum to a desired potential, following which an exposing apparatus irradiates the surface of the photosensitive drum with light in accordance with image information, thereby forming an electrostatic latent image. A developing apparatus then develops the electrostatic latent image by using toner, a transferring apparatus transfers the developed toner image onto a recording material such as paper or the like, and a fixing apparatus fixes the developer image transferred onto the recording material. Thus, an output image is obtained.

The developing apparatus includes a container that holds toner, a developing roller that transports toner to the surface of the photosensitive drum, a toner supply roller that supplies toner onto the developing roller, a toner control member that comes into contact with the surface of the developing roller and controls the amount of toner transported by the developing roller to a constant amount, and so forth. Also, when manufacturing an RS roller to serve as the toner supply roller, conductivity is imparted by adding an ionic conducting agent, and a certain potential difference (hereinafter, "supply bias") is generated between the developing roller and the toner supply roller, in order to supply toner to the developing roller in a stable manner. Also, a foam stabilizing agent may be used in a case of using a manufacturing method such as foam molding, to impart elasticity to the toner supply roller.

In the above configuration, in cases in which the toner supply roller or the developing roller are left standing for prolonged periods of time in a stationary state, components such as ionic conducting agent and unreacted foam stabilizing agent contained in the toner supply roller or the developing roller may be exuded. Further, the exuded components may migrate to other members in contact with the member that is the source of exuding in some cases, causing defects such as lateral streaks at the time of image forming.

Japanese Patent Application Publication No. 2009-237465 proposes a technology in which the foam stabilizing agent is suppressed from being exuded from the toner supply roller to other members, by changing the manufacturing method of the toner supply roller.

SUMMARY OF THE INVENTION

However, there are cases in which the amount of ionic conducting agent added to the toner supply roller is increased, in order to suppress change in resistance due to electric deterioration when using the toner supply roller or the like for prolonged periods of time, for example. In such cases, the amount of ionic conducting agent exuded increases, and accordingly, suppressing the exuding by a method according to the related art alone is difficult.

The present invention has been made in view of the foregoing problem, and it is an object thereof to suppress image detects due to contact of toner supply rollers and developing rollers in image forming apparatuses.

The present invention provides an image forming apparatus capable of executing an image forming operation of forming an image on a recording material, the image forming apparatus comprising:

an image bearing member configured to be rotatable;

a developing member configured to supply a developer that is charged to a regular polarity to a surface of the image bearing member;

a developer supply member configured to come into contact with a surface of the developing member and to supply the developer to the surface of the developing member;

a first voltage applying unit configured to apply a first voltage to the developing member;

a second voltage applying unit configured to apply a second voltage to the developer supply member; and a control unit configured to control the first voltage applying unit and the second voltage applying unit, wherein the control unit controls the image forming operation to be executed, and a rotational operation in which the developer supply member rotates in a state in which the first voltage of a same polarity as the regular polarity is applied thereto to be executed, the rotational operation including a first rotational operation in which a first potential difference is formed between the developing member and the developer supply member, and a second rotational operation in which the developing member and the developer supply member rotate in a state in which the second voltage having the same polarity as the regular polarity and having a greater absolute value than the first voltage is applied, and a second voltage difference is formed between the developing member and the developer supply member, and in a case in which a potential difference generated between the developing member and the developer supply member in the image forming operation is a third potential difference, the control unit controls a magnitude of potential difference in a direction of electrostatic force acting on developer charged to the regular polarity from the developer supply member toward the developing member, in which the first potential difference is smaller than the third potential difference, and in which the second potential difference is greater than the third potential difference.

The present invention also provides an image forming apparatus, comprising:

an image bearing member configured with a surface on which an electrostatic latent image is formed;

a developing member that is rotatable and that is configured to develop the electrostatic latent image on the surface of the image bearing member and form a developer image;

a developer supply member configured to supply the developer, while rotating in contact with the developing member; and a control unit, wherein the control unit controls an image forming operation in which the developer image is formed to be executed, and a cleaning mode in which a component adhering to a surface of the developing member is removed to be executed, the cleaning mode including a first rotational operation in which the component adhering to the surface of the developing member is scraped off by the developer supply member, by rotational driving of at least the developer supply member, and a second rotational operation in which the component scraped off by the developer supply member is relocated to the image bearing member by the developing member, by performing rotational driving of the developer supply member, the developing member, and the image bearing member.

According to the present invention, image defects due to contact of toner supply rollers and developing rollers in image forming apparatuses can be suppressed.

Further features of the present invention will become apparent from the following description of exemplary embodiments with reference to the attached drawings.

DESCRIPTION OF THE EMBODIMENTS

Embodiments for carrying out the invention will be exemplarily described below in detail by way of Examples, with reference to the Figures. It should be noted, however, that dimensions, materials, and shapes, of components described in the embodiments, and relative layouts thereof, and so forth, should be changed as appropriate in accordance with configurations of apparatuses to which the invention is to be applied, and various types of conditions. That is to say, this description does not intend to limit the scope of the invention to the following embodiments.

Example 1

Overview of Image Forming Apparatus

A schematic overall configuration of an electrophotographic system image forming apparatus 100 and image forming operations according to Example 1 of the present invention will be described with reference to a schematic cross-sectional view in FIG. 1.

Figure 1:
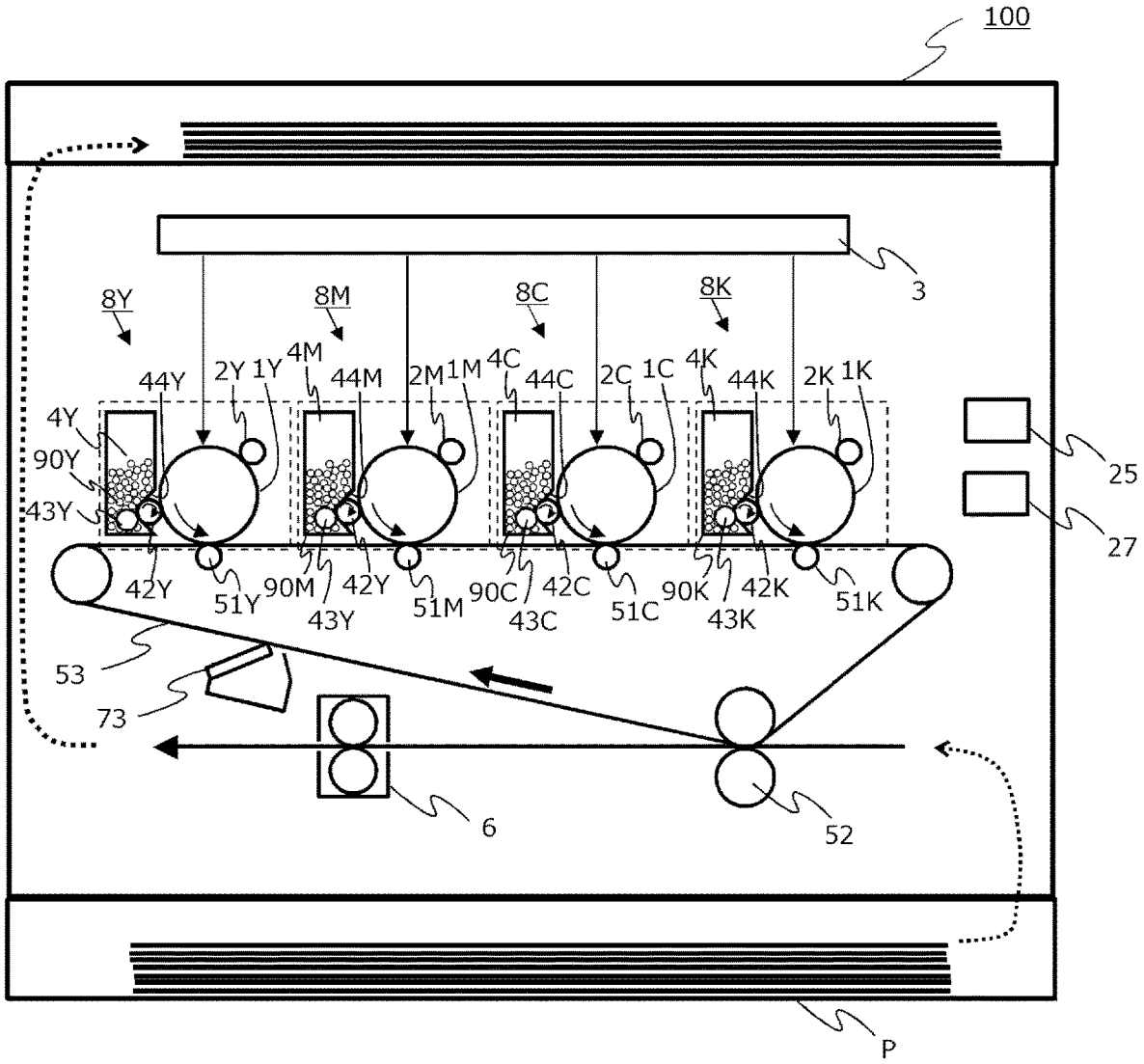
FIG. 1 is a schematic configuration diagram illustrating an example of an image forming apparatus according to the present invention.

In the present Example, image forming stations (image forming units) of four colors of yellow, magenta, cyan, and black are arrayed in tandem, from the left side to the right side in FIG. 1. The image forming stations are of the same configuration as each other, except for developer (toner) 90 accommodated in each developing apparatus being a different color. Suffixes Y (yellow), M (magenta), C (cyan), and K (black), appended to the signs to indicate for which color the elements are provided, will be omitted in cases in which there is no particular need to differentiate therebetween in the following description, and description will be made collectively.

Each image forming station has a photosensitive drum 1, a charging roller 2, a developing apparatus 4, a primary transfer device 51, and so forth, as a primary configuration. An exposing apparatus 3 may be provided in common for the image forming stations, or may be provided individually for each image forming station.

In the present Example, the photosensitive drum 1, the charging roller 2, and the developing apparatus 4 are integrated as a process cartridge 8, which is configured to be detachably mountable to an image forming apparatus main unit (the portion of the image forming apparatus 100 excluding the process cartridge 8). Note however, that the process cartridge according to the present invention may be configured including at least the photosensitive drum 1 and the developing apparatus 4, and being detachably mountable to the apparatus main unit en bloc. The developing apparatus 4 may also be configured to be individually detachably mountable to the apparatus main unit or the process cartridge 8. Also, the photosensitive drum 1 and the developing apparatus 4 may be bound to the image forming apparatus main unit, with no replacement by the user being necessary.

The photosensitive drum 1 (image bearing member) is a cylindrical photosensitive member that rotates on the axis of the cylinder in the direction indicated by the arrows (counterclockwise direction in the plane of FIG. 1). In the present Example, the outer circumferential face is rotationally driven at a speed of 100 mm/sec.

The surface of the photosensitive drum 1 is uniformly charged by the charging roller 2. In the present Example, the charging roller 2 (charging means) is a conductive roller in which a conductive rubber layer is provided on a core. The charging roller 2 is disposed in parallel with the photosensitive drum 1 and in contact therewith at a predetermined pressure, rotating in conjunction with rotation of the photosensitive drum 1. In the present Example, direct current (DC) voltage of −1100 V is applied to the charging roller 2 as charging voltage, thereby charging the photosensitive drum 1, and at this time the surface potential (charging potential) of the photosensitive drum 1 is around −550 V.

Image signals are input to a control unit 25 of the image forming apparatus main unit in accordance with a user request, from an image reader device connected to the image forming apparatus 100 main unit, or a host device such as a personal computer or the like communicably connected to the image forming apparatus 100 main unit. The exposing apparatus 3 acquires the image signals from the control unit 25 and scans the surface of the photosensitive drum 1 with laser light in accordance with the image signals. Thus, an electrostatic latent image is formed on the charged photosensitive drum 1, in accordance with the image signals. An information processing device, such as a control circuit or the like that is provided with computation resources such as a processor, memory, and so forth, for example, can be used as the control unit 25. At image printing portions exposed on the photosensitive drum 1, at which toner images (developer images) are to be formed, the surface potential (exposing potential) is controlled to be lower than applied voltage of a developing roller 42. Conversely, the surface potential is controlled to −550 V at non-printing portions where no toner images are formed. Accordingly, toner charged to the potential difference as to the developing roller 42 at the image printing portions is developed.

The developing apparatus 4 supplies the toner 90 to the electrostatic latent image on the photosensitive drum 1, and visualizes the electrostatic latent image as a toner image. In the present Example, the developing apparatus 4 is a contact-development type reverse-development apparatus that includes the toner 90 as a mono-component developer having negative regular polarity (charging polarity for developing the electrostatic latent image).

The developing apparatus 4 is provided with the developing roller 42 (developing member) and a toner supply roller 43 (developer supply member) that are rotatably disposed in contact with each other. The developing apparatus 4 is further provided with a regulating blade 44 (developer control member). The toner supply roller 43 is an elastic sponge roller with a foamed member formed on the outer circumference of a conductive core.

In the present embodiment, an article having an urethane foam layer and also containing an ionic conducting agent was used for the toner supply roller 43. As one example, the toner supply roller 43 according to the present Example has a configuration in which an ionic conducting agent, configured of salts of cations and anions having a reactive functional group that reacts with an isocyanate group, is chemically bonded with the urethane foam layer by the reactive functional group. A toner supply roller 43 having such a configuration can be manufactured by foaming and curing a urethane composition containing an ionic conducting agent, for example. However, when unreacted component (foam stabilizing agent, etc.) remaining without completely reacting in the reacting process of the urethane foam layer and the ionic conducting agent are exuded through moisture to the developing roller 42 with which the toner supply roller 43 is in contact, image defects such as lateral streaks and so forth occur.

The toner supply roller 43 is disposed to be in contact with the developing roller 42 at a predetermined penetration level. The thickness of the layer of toner 90 that is supplied by the toner supply roller 43 and carried by the developing roller 42 is reduced by the regulating blade 44, and used for developing. The regulating blade 44 here has a function of regulating the thickness of the layer of toner 90 on the developing roller 42, and a function of serving as developer charging means of imparting a predetermined charge to the toner 90 on the developing roller 42.

The developing roller 42 is rotationally driven in a direction so that the direction of movement of the surface thereof is the same as that of the photosensitive drum 1, i.e., the direction indicated by the arrows on the axis of the cylinder (clockwise direction in the plane of FIG. 1). In the present Example, the developing roller 42 is rotationally driven at a speed such that the traveling speed of the surface of the developing roller 42 is 140% of the traveling speed of the surface of the photosensitive drum 1, in order to obtain an appropriate image density. Also, the developing apparatus 4 is pressed against the photosensitive drum 1 side by biasing means omitted from illustration, and as a result, the developing roller 42 is pressed against the photosensitive drum 1. Thus, the surface of the developing roller 42 is deformed, forming a developing nip, whereby stable developing can be performed in a stable contact state.

The toner image formed on the photosensitive drum 1 is electrostatically transferred onto an intermediate transfer belt 53 by the primary transfer device 51. Toner images of each of the colors are transferred onto the intermediate transfer belt 53, being sequentially overlaid, thereby forming a full-color toner image. The full-color toner image is then transferred onto a recording material P by a secondary transfer device 52. Thereafter, the toner image on the recording material is pressurized and heated by a fixing apparatus 6 so as to be fixed on the recording material P, and is discharged as an image-formed article. The above-described input of image signals by the user through discharge as an image-formed article will be referred to as "during image forming", and during the control when performing image forming will be referred to as "image forming mode".

Also, a belt cleaning apparatus 73 is disposed on the downstream side of the secondary transfer device 52 in the direction of travel of the intermediate transfer belt 53, removing and recovering the toner 90 remaining on the intermediate transfer belt 53.

In the present Example, an image-bearing-member cleanerless system, in which no cleaner apparatus dedicated to the photosensitive drum 1 is provided, is employed. From the time at which a portion of the surface of the photosensitive drum 1 passes an opposing position of the primary transfer device 51 (primary transfer position) to the time at which this portion reaches a position of contact with the charging roller 2 (charging position), there is no member that comes into contact with this portion of the surface of the photosensitive drum 1. Accordingly, when the developing roller 42 of the developing apparatus 4 is brought into contact with the photosensitive drum 1, the toner 90 remaining on the photosensitive drum 1 can be recovered to the developing apparatus 4. Note however, that the above configuration is not limiting in obtaining the effects of the present invention.

An electric power source apparatus 27 is capable of applying developing voltage (first voltage) to the developing roller 42 via a developing voltage applying unit 21 (first voltage applying unit), and supply voltage (second voltage) to the toner supply roller 43 via a supply voltage applying unit 22 (second voltage applying unit), respectively. The electric power source apparatus 27 may be a single apparatus, or separate power sources may be provided in accordance with the object. Also, the electric power source apparatus 27 may be used for applying voltage when performing image transfer, or a transfer power source may be provided separately. Also, the electric power source apparatus 27 may be used for applying control voltage to the regulating blade 44. The electric power source apparatus 27 may also supply voltage to the charging roller 2, or a charging power source may be provided separately. The electric power source apparatus 27 according to the present Example changes the voltage applied to each of the components, under control of the control unit 25. Note that in a case of providing power source apparatuses individually for each object of applying voltages, the plurality of power sources may be collectively considered to be power source means.

Bias Voltages During Normal Image Forming

Next, bias voltages that the control unit 25 controls the electric power source apparatus 27 to apply to the developing roller 42, the toner supply roller 43, and the regulating blade 44, during normal image forming according to the present Example, will be described. The bias voltage (supply voltage) applied to the toner supply roller 43 is −400 V. The bias voltage (developing voltage) applied to the developing roller 42 is −300 V. Accordingly, the potential difference between the toner supply roller 43 and the developing roller 42 is (−400 V)−(−300 V)=−100 V. This is the direction in which the toner 90 is biased from the toner supply roller 43 to the developing roller 42.

Also, the bias voltage (control voltage) applied to the regulating blade 44 is −400 V. Accordingly, the potential difference between the regulating blade 44 and the developing roller 42 is (−400 V)−(−300 V)=−100 V. This is the direction in which the toner 90 is biased from the regulating blade 44 to the developing roller 42. Also, the potential on the surface of the photosensitive drum 1 (charging potential Vd) is −550 V, as described earlier. Accordingly, the potential difference between the developing roller 42 and the surface of the photosensitive drum 1 is (−550 V)−(−300 V)=−250 V.

Study of Lateral Streaks

Image output was performed using the image forming apparatus 100 such as described above, under conditions simulating long-term standing. For conditions of leaving standing, process cartridges 8 were left standing in a thermostatic bath set to 40° C. and humidity of 95% for thirty days. The image to be output was a solid black image. A solid black image is an image in which the entire region in which image forming can be performed is printed, and can also be said to be an image in which the print percentage is greatest. There were cases in which lateral streaks occurred within the solid black image when performing image output using this process cartridge 8.

The cause of lateral streaks will be studied. As a result of long-term standing, unreacted components and ionic conducting agent contained in the toner supply roller 43 (hereinafter also referred to as "exudation") may migrate to toner interposed between the developing roller 42 and the toner supply roller 43, and to the surface of the developing roller 42, through moisture in the air. As a result, the adhered exudation becomes layered as a resistance layer at the initial contact position of the developing roller 42 and the toner supply roller 43, and resistance rises by an amount equivalent to the layer of the exudation at the contact position. Accordingly, the amount of toner 90 supplied onto the developing roller 42 by the supply bias Vb (constant potential difference between the developing roller 42 and the toner supply roller 43) is reduced at the location where the exudation is present, and lateral streaks occur in accordance with the pitch of the developing roller 42.

As a result of study, the following method was found to be effective in reducing occurrence of lateral streaks. That is to say, this is to rotationally drive the developing roller 42 and the toner supply roller 43 for a certain amount of time in a state in which the developer coating amount of the toner 90 on the developing roller 42 is small. Hereinafter, this rotational driving will be referred to as "cleaning-mode first operation" or "first rotational operation". Accordingly, the exudation that migrated to the surface of the developing roller 42 and adhered thereto can be scraped off by the toner supply roller 43 and thus removed.

Now, a state in which the coating amount of the toner 90 on the developing roller 42 is small is as follows. The amount of toner 90 coated thereupon under each of the bias voltage conditions during normal image forming will be referred to as a normal amount. When the developing roller 42 and the toner supply roller 43 are rotationally driven in a state in which a smaller supply bias ("first supply bias Vb1" or "first potential difference") than the supply bias during image forming ("third supply bias Vb3" or "third potential difference") is supplied, the toner coating amount is smaller than normal. In order to realize such a toner supply amount, the electric power source apparatus 27 increases the first supply bias Vb1 in the direction of opposite polarity as to the regular polarity of the toner 90, in comparison with the third supply bias Vb3. Note that in order to realize the scraping in the first operation, it is sufficient for at least the toner supply roller 43 to be rotating.

In the present Example, the first supply bias Vb1 for when scraping off the adhering components in cleaning is preferably set to a range of $-50\ V \leq Vb1 \leq 300\ V$. The reason for setting to the above range will be described below in detail. The lower limit side of the first supply bias Vb1 is the smallest value of Vb1 at which the amount of the toner 90 on the developing roller 42 can be reduced to just that necessary for scaping off. That is to say, in the present Example, there is a possibility that the toner coating amount will increase and the amount of scraping off will decrease when the supply bias Vb1 changes in the direction of the same polarity as the regular polarity beyond −50 V (comes nearer to −100 V).

In contrast, with regard to the upper limit side of the first supply bias Vb1, the greater the first supply bias Vb1 is as compared to the third supply bias Vb3 during image forming, in the direction of opposite polarity as to the regular polarity, the better, when only scraping operations are taken into consideration. However, when the supply bias is excessively great, the intake of toner 90 to the toner supply roller 43 becomes excessive, and there is a risk that supply performance during image forming may be compromised. Accordingly, the upper limit side is the greatest value at which the toner supply roller 43 can be used without causing excessive intake of toner 90.

Note that changing the supply bias in the present Example may be performed by changing one or the other of the developing voltage and the supply voltage, or by changing both.

Also, the time of performing the above rotational driving will be described. After the toner 90 has been scraped off from the developing roller 42, the surface of the developing roller 42 needs to be scraped, and accordingly the rotational driving of the developing roller 42 needs to be performed at least two rotations or more, for the above scraping operation.

Study of Fogging

When performing later-described experiments with the image forming apparatus left standing as described above, there were cases in comparative examples in which "fogging" worsened. Note that "fogging" as used here is a phenomenon in which the toner 90 is developed in a non-developing portion.

Causes of fogging occurring can be conceived as follows. The toner 90 to which exudation migrated to due to the long-term standing readily loses charge and does not readily maintain a charged state, and thus fogging, in which non-image portions are developed by the toner 90, occurs.

The following method is effective in mitigating occurrence of fogging. That is to say, this is a method in which contaminated toner to which exudation has migrated, which has been scraped off by the scraping operations at the time of controlling to a state of a small toner coating amount, is maximally discharged to the outside of the developing apparatus 4 in advance.

The following operation is performed in the present Example, in order to discharge contaminated toner to the outside of the developing apparatus 4. That is to say, the apparatus is operated with a second supply bias Vb2 for fogging mitigation (also referred to as "second potential difference") increased in the same polarity side as the regular polarity of the toner 90, as compared to the third supply bias Vb3 during image forming. Accordingly, the contaminated toner 90 carried by the toner supply roller 43 can be maximally supplied onto the developing roller 42. The contaminated toner 90 relocated to the developing roller 42 can then be relocated to the photosensitive drum 1, by exposing the photosensitive drum 1 and performing rotational driving of the developing roller 42 and the photosensitive drum 1. Hereinafter, this series of toner discharging processing will be referred to as "cleaning-mode second operation" or "second rotational operation".

The second supply bias Vb2 is preferably set within the range of $-300\ V \leq Vb2 \leq -150\ V$. To this end, the supply voltage applying unit 22 applies a voltage that is the regular polarity in the same way as in the supply voltage in the first operation, and that has a greater absolute value than in the first operation, as the supply voltage in the second operation. The reason for setting to the above range will be described below in detail. The upper limit side of the second supply bias Vb2 is the greatest value of the second supply bias Vb2 at which contaminated toner carried by the toner supply roller 43 can be discharged without manifesting fogging.

In contrast, with regard to the lower limit side of the second supply bias Vb2, the smaller the second supply bias Vb2 is as compared to the third supply bias Vb3 during image forming, in the same polarity side as to the regular polarity the better, when only discharging operations are taken into consideration. However, when the second supply bias Vb2 is excessively small, there is a possibility that excessive supply of toner 90 to the developing roller 42 will cause toner filming thereof. Accordingly, the lower limit side is the smallest value at which the developing roller 42 can be used without causing toner filming.

The above exuding phenomenon tends to occur due to the process cartridge 8 (or the developing apparatus) being left standing in a high-humidity environment for prolonged periods of time in an unused state. In particular, exuding phenomenon readily occurs before initial setup when the process cartridge 8 is mounted to the image forming apparatus main unit. Note that "standing" is not limited to cases of not moving at all in the strict sense, and includes cases of being left standing for a degree of time at a degree of operation under which exudation of component will occur.

The relation among the above-described first supply bias Vb1, the second supply bias Vb2, and the third supply bias Vb3 can be summarized as follows. When considering the supply bias (potential difference) in a direction of electrostatic force heading from the toner supply roller 43 toward the developing roller 42 acting upon toner 90 charged to the regular polarity (negative here), the control unit 25 performs control such that the first supply bias Vb1 is smaller than the third supply bias Vb3, whereby scraping is performed in the cleaning-mode first operation. By the control unit 25 performing control such that the second supply bias Vb2 is greater than the third supply bias Vb3, discharging to prevent fogging is performed in the cleaning-mode second operation. Note that the control unit 25 may change either of the supply voltage and the developing voltage, as long as the supply bias can be changed as described above.

In the present Example, control in which the cleaning-mode first operation and the cleaning-mode second operation are performed in sequence (hereinafter collectively referred to as "cleaning mode") is executed as follows. That is to say, the cleaning mode is executed as control performed during the time from mounting a new developing apparatus 4 to the image forming apparatus 100 main unit until reaching a standby state (READY state) in which image forming operations are executable (initial setup operations). Note however, that it is sufficient for the cleaning mode to be executed in a non-image-forming time in order to obtain the effects of the present invention, and is not limited to the initial setup. For example, the cleaning mode may be executed during periodic maintenance. Also, the cleaning mode may be executed when determination is made that a predetermined period has elapsed from usage the previous time to usage this time. Also, the cleaning mode may be executed under instruction from a user.

Initial Setup Operation Control

Figure 2:
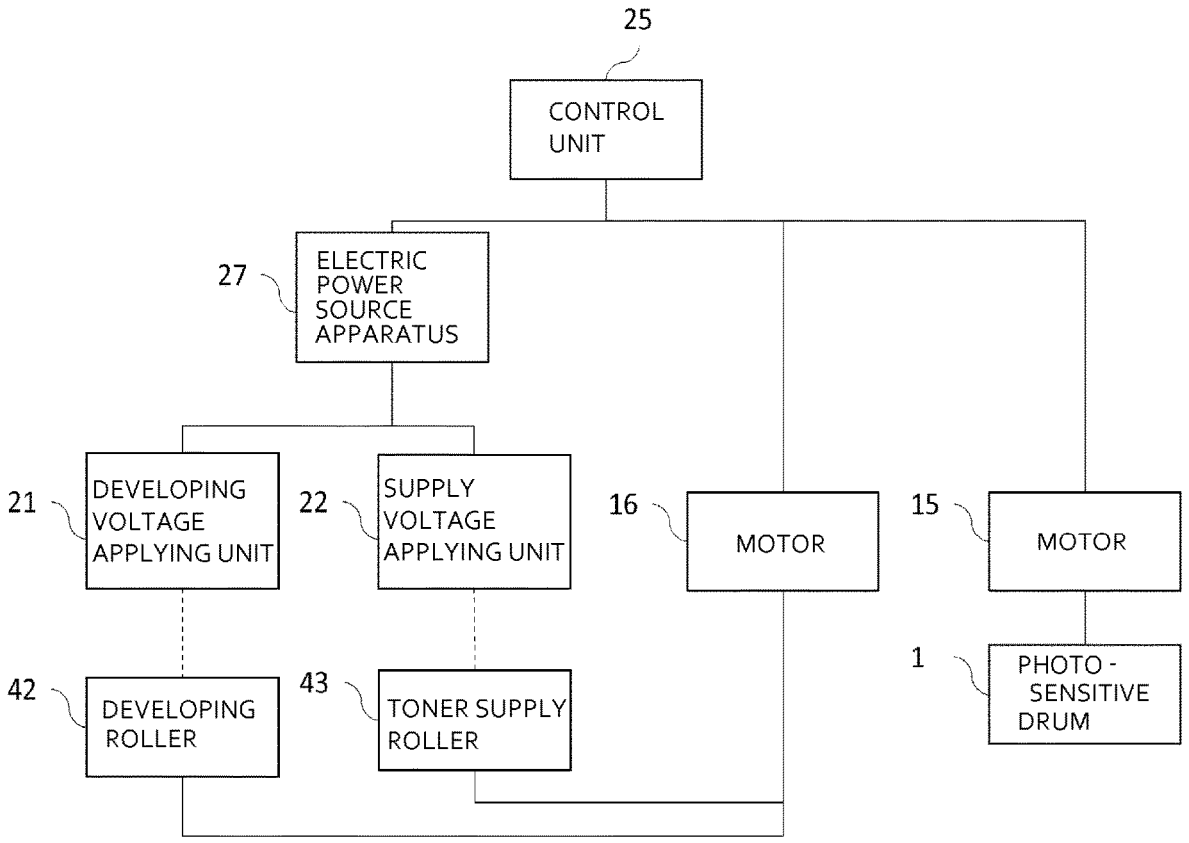
FIG. 2 is a block diagram illustrating a configuration of a control system of the image forming apparatus.

Control of initial setup operations according to the present Example will be described. FIG. 2 is a block diagram illustrating a control system of the image forming apparatus 100. The control unit 25 controls the electric power source apparatus 27 to apply developing voltage from the developing voltage applying unit 21 to the developing roller 42, and to apply supply voltage from the supply voltage applying unit 22 to the toner supply roller 43. The developing voltage applying unit 21 and the supply voltage applying unit 22 are each control mechanisms that supply voltage necessary for operation, and may be configured as part of the electric power source apparatus 27. The control unit 25 also drives a motor 15 to convey rotational driving force to the photosensitive drum 1, and drives a motor 16 to convey rotational driving force to the developing roller 42 and the toner supply roller 43.

Figure 3:
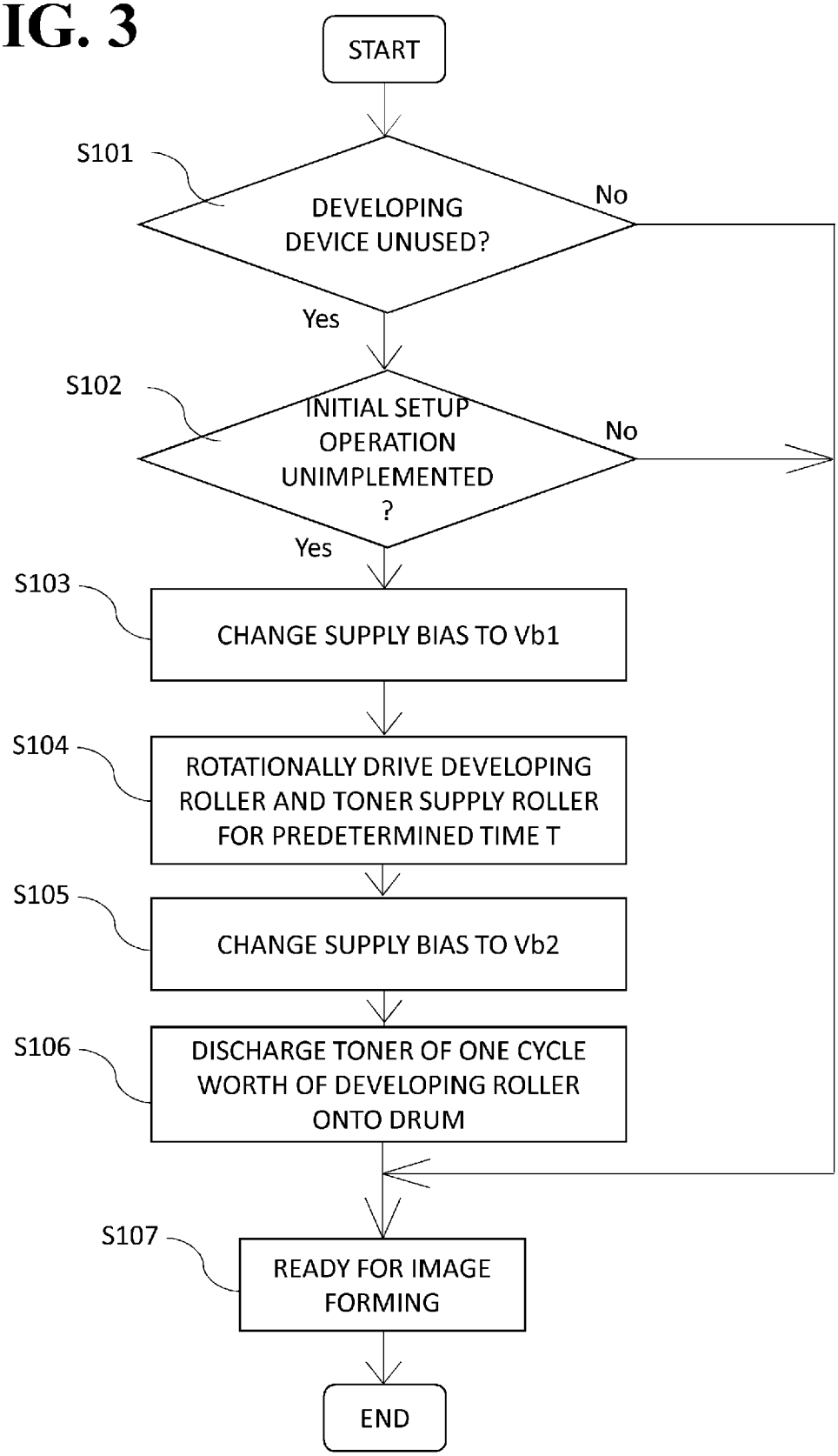
FIG. 3 is a flowchart showing initial setup operations according to Example 1.

FIG. 3 shows a processing flow according to the present Example. The image forming apparatus 100 according to the present Example performs initial setup operations in which the developing roller 42 and the toner supply roller 43 of the developing apparatus 4, and the photosensitive drum 1 are rotationally driven the first time that a new developing apparatus 4 is mounted to the main unit of the image forming apparatus 100.

In step S101 in FIG. 3, the control unit 25 serving as control means determines whether or not the developing apparatus 4 is unused (new). Whether or not the developing apparatus 4 is unused (new) can be detected by desired known detecting means. If the developing apparatus 4 is unused, the flow advances to step S102, and if the developing apparatus 4 is not unused, the flow advances to step S107 and goes to a standby state (READY state) in which image forming operations can be performed.

In step S102, the control unit 25 determines whether or not initial setup operations have been implemented. If the initial setup operations are unimplemented, the flow advances to step S103, and if the initial setup operations have already been implemented, the flow advances to step S107 and goes to the standby state (READY state) in which image forming operations can be performed. For example, whether or not initial setup operations are implemented can be confirmed by preparing a flag in memory indicating whether or not initial setup has been performed.

In step S103, the control unit 25 controls the supply voltage applying unit 22 such that the applied bias of the toner supply roller 43 is −350 V. Accordingly, the potential difference between the developing roller 42 and the toner supply roller 43 during cleaning, i.e., the first supply bias Vb1 is set to −50 V. Next, in step S104, the control unit 25 rotationally drives the motor 16 and rotationally drives the toner supply roller 43 and the developing roller 42 for a predetermined amount of time.

Next, in step S105, the control unit 25 controls the supply voltage applying unit 22 such that the applied bias to the toner supply roller 43 is −500 V. Accordingly, the potential difference between the developing roller 42 and the toner supply roller 43, i.e., the second supply bias Vb2, is set to −200 V. In the following step S106, the exposing apparatus 3 performs laser exposure on the photosensitive drum 1 for performing solid printing of a predetermined length, and rotationally drives the motor 15 and the motor 16 to rotationally drive the photosensitive drum 1, the toner supply roller 43, and the developing roller 42 for a predetermined amount of time. Thereafter the flow advances to step S107 and goes to the standby state (READY state) in which image forming operations can be performed.

The time of rotational driving of the developing apparatus 4 in step S104 differs depending on the configuration of the developing apparatus 4. Accordingly, a suitable time can be set as appropriate. In the present Example, the number of rotations of the developing roller 42 was set to 560 rotations, i.e., the developing apparatus 4 was rotationally driven for 700 seconds, assuming variance due to the state of storage and so forth of the developing apparatus 4. As a result, exudation on the developing roller 42 was successfully scraped off to a degree at which no lateral streaks occurred.

The time of rotational driving of the developing apparatus 4 in step S106 is a time of the developing roller 42 being rotationally driven for at least one cycle or more. Accordingly, the time differs depending on the diameter of the developing roller 42. Thus, a suitable amount of time can be set as appropriate. In the present embodiment, the number of rotations of the developing roller 42 was set to one rotation, i.e., the developing apparatus 4 was rotationally driven for 0.125 seconds, assuming variance due to the state of storage and so forth of the developing apparatus 4, and discharge of toner 90 onto the photosensitive drum 1 was performed. As a result, contaminated toner 90 on the toner supply roller 43 was successfully discharged to a degree at which no fogging occurred.

Table 1 shows results of comparative experiments performed while confirming the level of lateral streaks occurring, in a case of performing initial setup operations under various bias voltage conditions, using developing apparatuses 4 left standing to simulate long-term standing, in order to clarify the effects of the present Example. Description will be made below while comparing Example 1 and Comparative Examples 1-1 and 1-2.

TABLE 1

| | V b 1 | V b 2 | Lateral streaks | Fogging |
|---|---|---|---|---|
| Comparative Example 1-1 | −100 | −100 | x | ○ |
| Comparative Example 1-2 | −50 | −100 | ○ | x |
| Example 1 | −50 | −200 | ○ | ○ |

In order to simulate standing as a prerequisite for the experiments shown in Table 1, developing apparatuses 4 were left standing in a thermostatic bath set to a temperature of 40° C. and humidity of 95% for thirty days. The environment for performing the experiments shown in Table 1 thereafter were temperature of 23° C. and humidity of 50%. In each case, a process cartridge 8 left standing was mounted to the image forming apparatus 100 main unit, and initial setting operations were executed. Immediately following execution of the initial setting operations under each of the bias voltage conditions, a solid black image and a solid white image (image with nothing printed) over the entirety in the longitudinal direction of the photosensitive drum 1 were printed.

In Table 1, the level of occurrence of lateral streaks in the solid black images was evaluated in three stages, in which cases in which lateral streaks were not visually discernible at all are indicated by "Good", cases in which lateral streaks were slightly visually discernible are indicated by "Fair", and cases in which lateral streaks of a visually intolerable level occurred are indicated by "Poor". In the same way, the level of occurrence of fogging in the solid white images was evaluated in three stages, in which cases in which fogging was not visually discernible at all are indicated by "Good", cases in which fogging was slightly visually discernible are indicated by "Fair", and cases in which fogging of a visually intolerable level occurred are indicated by "Poor".

Comparative Example 1-1

In Comparative Example 1-1, the first supply bias Vb1 in step S104 for scraping off the surface of the developing roller during initial setup operations, and the second supply bias Vb2 in step S106 for performing toner discharge were −100 V. In this case, lateral streaks occurred, but no fogging occurred.

This will be described below in further detail. In the scraping operation in step S104, the supply bias is equal to that during image forming, and accordingly a great amount of toner is interposed between the surface of the developing roller 42 and the toner supply roller 43, and scraping of the surface of the developing roller 42 by the toner supply roller 43 is not sufficiently performed. Accordingly, exudation remained on the developing roller 42, and lateral streaks occurred.

Comparative Example 1-2

In Comparative Example 1-2, the first supply bias Vb1 in step S104 for scraping off the surface of the developing roller 42 during initial setup operations was −50 V, and the second supply bias Vb2 in step S106 for performing toner discharge was −100 V. In this case, while improvement in lateral streaks as compared to Comparative Example 1-1 was observed, fogging became worse.

This will be described below in further detail. By setting the first supply bias Vb1 during the scraping operations in step S104 to −50 V, a state in which the toner coating amount on the developing roller 42 is small occurs only during the scraping operations. Accordingly, the toner supply roller 43 and the developing roller 42 are in a state of coming into contact via less toner 90, and scraping off the exudation adhering to the surface of the developing roller 42 is facilitated. Accordingly, the amount of exudation on the surface of the developing roller 42 at the time of ending the scraping operations decreased, and the level of lateral streaks improved. Meanwhile, the scraped exudation accumulates in the developing container, and accordingly more matter causing fogging remained within the developing container as compared with Comparative Example 1-1, and could not be sufficiently discharged, leading to worsened fogging.

Example 1

In Example 1 shown in Table 1, the first supply bias Vb1 in step S104 for scraping off the surface of the developing roller 42 during initial setup operations was −50 V, and the second supply bias Vb2 in step S106 for performing toner discharge was −200 V. In this case, both lateral streaks and fogging improved as compared to Comparative Examples 1-1 and 1-2.

This will be described below in further detail. By setting the supply bias for discharging in step S106 to −200 V, the toner coating amount at the time of discharging increases as compared to Comparative Example 1-2. Accordingly, the toner discharge amount increased, and toner including scraped exudation that causes fogging was sufficiently discharged onto the photosensitive drum 1, thereby improving fogging.

By appropriately controlling the supply bias and executing the cleaning mode in the initial setup operations as in the present Example, effects on the image quality can be suppressed in a case of using a long-term standing process cartridge, and good images can be formed. In particular, by providing the first operation and the second operation in the cleaning mode, and appropriately setting the supply bias and the continuance time for each of the operations, effects can be exhibited regarding both occurrence of lateral streaks and occurrence of fogging.

Example 2

Next, Example 2 will be described. Configurations and operations the same as in Example 1 are denoted by the same signs, and description will be omitted.

In the cleaning-mode first operation, the image forming apparatus 100 according to Example 2 discharges the toner 90 on the developing roller 42 onto the photosensitive drum 1, and thus the execution time of the cleaning mode per execution can be reduced in comparison with Example 1. In Example 2, the configuration of the image forming apparatus 100 itself is the same as the configuration of Example 1 illustrated in FIGS. 1 and 2, with the control during the cleaning mode by the control unit 25 being as shown in the flowchart in FIG. 4.

Cleaning Mode Execution Time

The execution time for the cleaning mode in Example 1 is (cleaning-mode first operation time)+(cleaning-mode second operation time)=700.125 seconds. Accordingly, in the present Example, the first operation time is shortened by improving the scraping effects in the cleaning-mode first operation time, which takes up the greater part of the execution time, in an attempt to reduce the overall driving time while obtaining effects the same as Example 1 as a result thereof.

Specific operations to improve the scraping efficiency will be described below. Relocating the toner 90 onto the developing roller 42 to the photosensitive drum 1 is effective in improving the scraping efficiency. Accordingly, toner 90 on the developing roller 42 that intrudes into the developing container can be eliminated or reduced, and thus rotational driving of the developing roller 42 and the toner supply roller 43 can be performed in a state with less toner coating amount as compared to Example 1. Note that the same effects can be obtained by performing the above operation at any timing during the first operation.

In the present Example, the cleaning mode is executed as follows. That is to say, the cleaning mode is executed as control performed during the time from mounting a new developing apparatus 4 to the image forming apparatus 100 main unit until reaching a standby state (READY state) in which image forming operations are executable (initial setup operations). In the same way as Example 1, it is sufficient for the cleaning mode to be executed in a non-image-forming time, and is not limited to in the initial setup.

Initial Setup Operation Control

Figure 4:
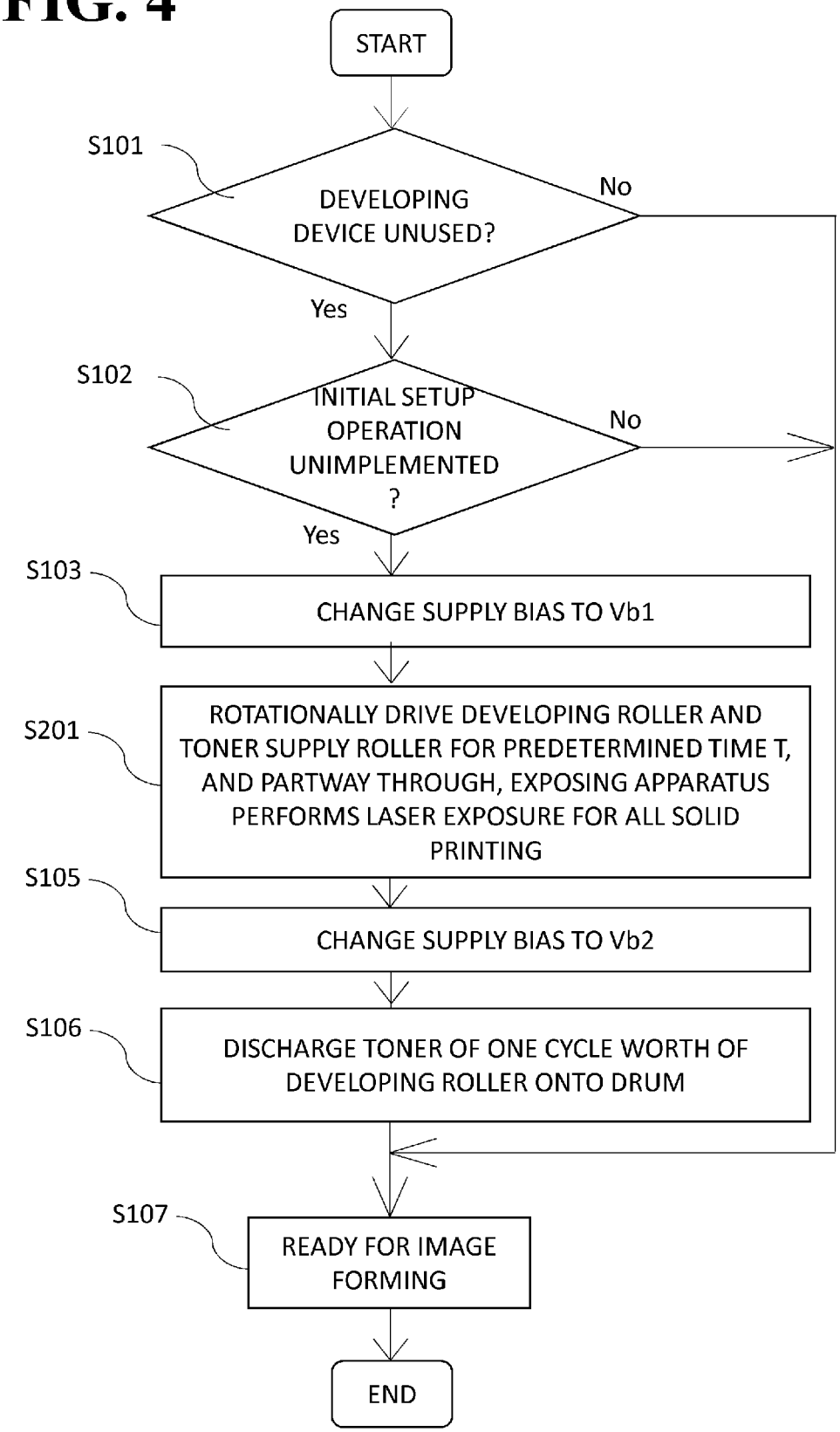
FIG. 4 is a flowchart showing initial setup operations according to Example 2.

FIG. 4 shows a processing flow of initial setup operations according to the present Example. Processes in which the same processing as in Example 1 is performed are denoted by the same signs. The image forming apparatus 100 according to the present embodiment performs initial setup operations in which the developing roller 42 and the toner supply roller 43 of the developing apparatus 4, and the photosensitive drum 1 are rotationally driven the first time that a new developing apparatus 4 is mounted to the image forming apparatus 100 main unit.

Operation control according to step S101 through step S103 is the same as in Example 1, and accordingly description will be omitted. Next, in step S201, the control unit 25 rotationally drives the motor 16 to rotationally drive the toner supply roller 43 and the developing roller 42 for a predetermined amount of time. This rotational driving is the same as in step S104 of Example 1. In the present Example, the exposing apparatus 3 performs laser exposure on the photosensitive drum 1 for performing solid printing of a predetermined length partway through this rotational driving. Thus, a predetermined amount of toner 90 on the developing roller 42 can be relocated onto the photosensitive drum 1.

Thereafter, control according to step S105 through step S107 is the same as the control of step S105 and thereafter, described in Example 1, and accordingly description will be omitted.

The amount of toner 90 relocated to the photosensitive drum 1 in step S201 differs depending on the configuration of the developing apparatus 4. Accordingly, a suitable amount can be set as appropriate. In the present Example, discharge of toner 90 onto the photosensitive drum 1 was performed for one rotation of the developing roller 42, assuming variance due to the state of storage and so forth of the developing apparatus 4.

In the present Example, the cleaning mode was executed on a developing apparatus 4 that was left standing in the same way as in Example 1. In doing so, the rotational driving time in step S201 was shortened as compared to the rotational driving time in step S104 in Example 1. Still, effects the same as those of Example 1 were obtained even in a case of the rotational driving time being shorter.

The time of the rotational driving of the developing apparatus 4 in step S201 differs depending on the amount of relocation of toner 90 to the photosensitive drum 1 in step S201. Accordingly a suitable time can be set as appropriate. In the present Example, it was found that by setting the number of rotations of the developing roller 42 to 480 rotations, i.e., rotationally driving the developing apparatus 4 for 600 seconds, assuming variance due to the state of storage and so forth of the developing apparatus 4, enabled the exudation on the developing roller 42 to be scraped off to a degree at which no lateral streaks occur.

Example 3

Next, configurations and operations according to Example 3 will be described. Configurations and operations the same as in the above Examples are denoted by the same signs, and description will be omitted.

In the image forming apparatus 100 according to Example 3, in a case in which image forming is performed using a developing apparatus 4 regarding which usage has been begun, following which the long-term standing occurs before performing image forming again, whether or not to implement the cleaning mode is judged in accordance with the length of the duration of the long-term standing. Accordingly, the number of times of executing the cleaning mode can be kept to the essential minimum, and the developing life can be extended.

Note that the image forming apparatus 100 according to Example 3 has, in addition to the configuration of Example 1, a recording unit that is omitted from illustration, which records a time T1 of transitioning to the image forming mode, and a time T2 of ending the image forming mode. The recording unit may be part of the control unit 25.

Long-Term Standing Case Control

Next, control of operations in a long-time standing case according to the present Example will be described with reference to FIG. 5. When performing image forming operations using a developing apparatus 4 mounted to the main unit of the image forming apparatus, the control unit 25 according to the present Example performs long-term standing case operations in a case in which a predetermined amount of time has elapsed from the image forming performed last. Specifically, long-term standing case operations are control in which the developing roller 42 and the toner supply roller 43 of the developing apparatus 4, and the photosensitive drum 1 are rotationally driven. Note that "long-term" differs depending on the design and state of the apparatus and constituents, and a predetermined amount of time in which exuding of components will occur can be set. Also, the operation time of the cleaning mode may be set in accordance with the time left standing. For example, the cleaning time may be lengthened in a case in which the time left standing is long and the amount of exuded components is great.

Figure 5:
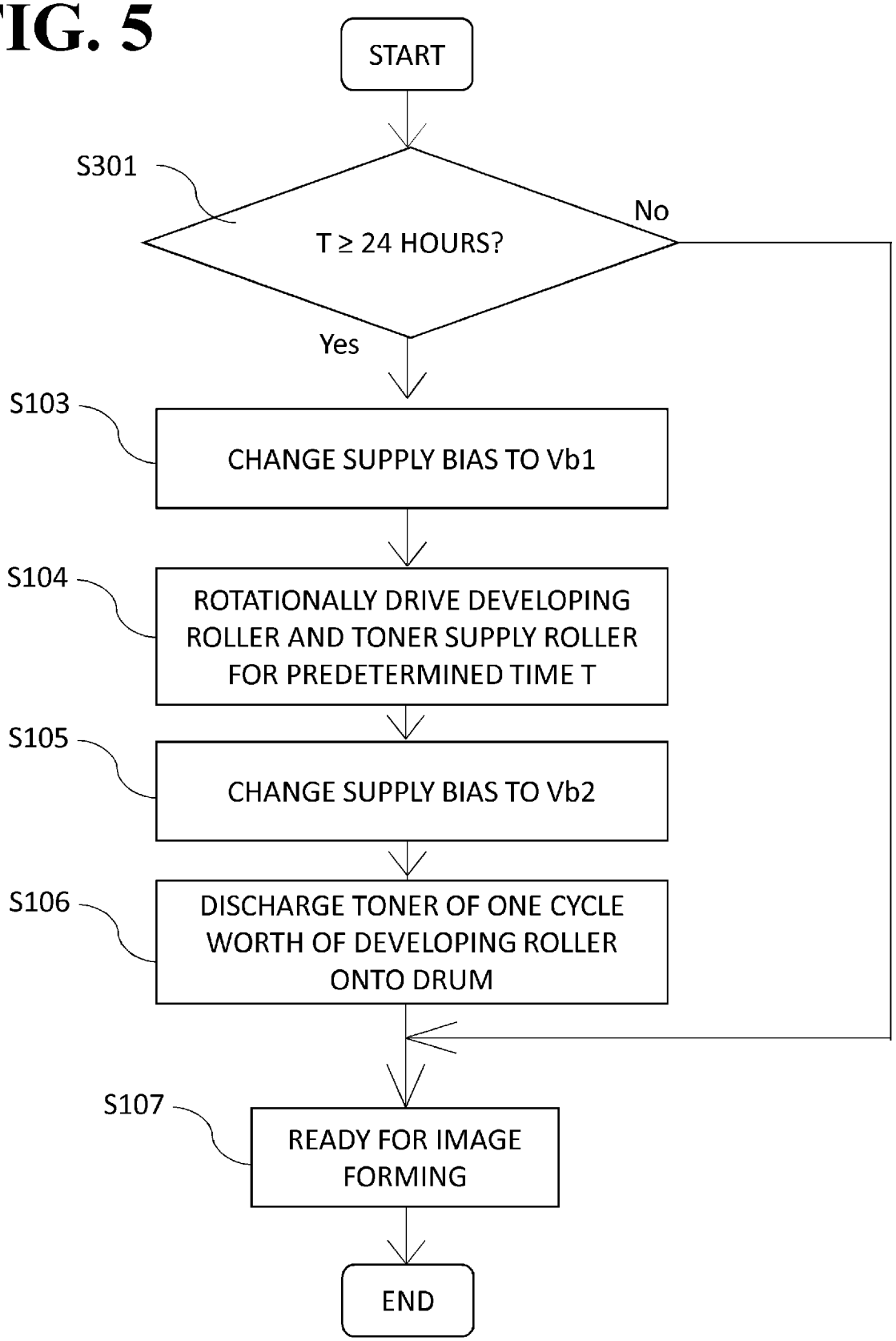
FIG. 5 is a flowchart showing long-term standing operations according to Example 3.

In step S301 in FIG. 5, the control unit 25 calculates a standing time T that is the difference between the time T1 of transitioning to the image forming mode, and the time T2 of ending the image forming mode last time (T2−T1=T). The control unit 25 then determines whether or not the standing time T is at least 24 hours. If the standing time T is at least 24 hours, the flow advances to step S103, and if the standing time T is not at least 24 hours, the flow advances to step S107 and goes to the standby state (READY state) in which image forming operations can be performed.

Conversely, the processing of step S103 and thereafter that the flow advances to if the standing time T is at least 24 hours (YES in step S301) is the same as the processing of step S103 and thereafter in Example 1.

Table 2 shows results of performing long-term standing case control under a plurality of conditions, using developing apparatuses 4 left standing to simulate long-term standing, in order to clarify the effects of the present Example. For conditions of simulating leaving standing, the developing apparatuses 4 were left standing in a thermostatic bath set to a temperature of 40° C. and humidity of 95% for thirty days. The evaluation image to be output during the durability test was a solid black image. Comparative Example 3-1 is conditions of not performing standing case control. Comparative Example 3-2 is conditions of executing the cleaning mode each time left standing regardless of the duration of the standing time, in long-term standing case control. Example 3 is conditions of performing the above-described long-term standing case control according to the present Example. Under these conditions, printing duration testing of 8000 prints was performed under the high-temperature and high-humidity environment shown below. Also, under each of the conditions, the developing apparatuses 4 were left standing for 48 hours after ending the durability test, after which the same evaluation image was output and evaluation was performed.

Printing Durability Test Conditions

Environment: temperature 30° C., humidity 80%

Printing mode: single-print intermittent 12-hour standing: every 1000 prints

Evaluation image output: every 1000 prints

In Table 2, the level of occurrence of lateral streaks in the solid black images was determined on the basis of the same determination reference as in Example 1. Also, the term "transfer defect" is a phenomenon in which the amount of transfer of toner 90 is insufficient due to some sort of cause at the time of transferring the toner 90 on the intermediate transfer belt 53 onto the recording material P by the secondary transfer device 52, and the density of the output image drops. Determination was made in three stages in which, regarding the level of transfer defect of the solid black images, cases in which change in density was not visually discernible at all are indicated by "Good", cases in which change in density was slightly visually discernible are indicated by "Fair", and cases in which change in density was an intolerable level occurred are indicated by "Poor".

The experiment results of Example 3 and Comparative Examples 3 shown in Table 2 will be described below.

TABLE 2

| | | | Duration test prints | | | | | | | | |
|---|---|---|---|---|---|---|---|---|---|---|---|
| | | | 1000 Prints | 2000 Prints | 3000 Prints | 4000 Prints | 5000 Prints | 6000 Prints | 7000 Prints | 8000 Prints | 8000 Prints |
| | | | Standing time before evaluation | | | | | | | | |
| | | | 12 Hours | 12 Hours | 12 Hours | 12 Hours | 12 Hours | 12 Hours | 12 Hours | 12 Hours | 48 Hours |
| Comparative example 3-1 | Cleaning mode | | Not executed | Not executed | Not executed | Not executed | Not executed | Not executed | Not executed | Not executed | Not executed |
| | Lateral streaks | | ○ ○ | ○ ○ | ○ ○ | ○ ○ | ○ ○ | ○ ○ | ○ ○ | ○ ○ | x x |
| | Transfer defects | | | | | | | | | | |
| Comparative example 3-2 | Cleaning mode | | Executed | Executed | Executed | Executed | Executed | Executed | Executed | Executed | Executed |
| | Lateral streaks | | ○ ○ | ○ ○ | ○ ○ | ○ ○ | ○ ○ | ○ ○ | ○ ○ | ○ ○ | ○ x |
| | Transfer defects | | | | | | | | | | |
| Example 3 | Cleaning mode | | Not executed | Not executed | Not executed | Not executed | Not executed | Not executed | Not executed | Not executed | Executed |
| | Lateral streaks | | ○ ○ | ○ ○ | ○ ○ | ○ ○ | ○ ○ | ○ ○ | ○ ○ | ○ ○ | ○ ○ |
| | Transfer defects | | | | | | | | | | |

Comparative Example 3-1

In Comparative Example 3-1, both lateral streaks and transfer defects were worse in a case of letting stand for 48 hours after ending the durability test. The reason thereof will be described below in detail. The cleaning mode is not executed in a long-term standing case in the Comparative Example 3-1. Accordingly, while lateral streaks did not occur in evaluation of the durability test with short standing time, the standing time in the evaluation after the durability test was 48 hours which is long, and lateral streaks and transfer defects occurred due to exudation migrating to the developing roller 42 and the toner 90.

Comparative Example 3-2

In Comparative Example 3-2, transfer defects occurred after ending the durability test. The reason thereof will be described below in detail. The cleaning mode is executed in the Comparative Example 3-2, regardless of the duration of standing time. Accordingly, lateral streaks in the evaluation after the durability test were improved over Comparative Example 3-1. However, the cleaning mode is executed each timing in the Comparative Example 3-2, even at timings where the standing time is short and the risk of lateral streaks occurring is low. Accordingly, the rotation time of the developing apparatus 4 increased due to the cleaning mode, thus promoting deterioration of the toner 90 within the developing apparatus 4, and increasing the proportion of toner 90 with deteriorated charging performance as compared to Comparative Example 3-1. As a result, the amount of toner 90 transferred in the secondary transferring decreased, and transfer defects occurred.

Example 3

Neither lateral streaks nor transfer defects occurred in Example 3. The reason thereof will be described below in detail. In Example 3, determination is made regarding whether to perform execution of the cleaning mode in accordance with the duration of the standing time. Accordingly, the cleaning mode is executed during standing after the durability test regarding which there is a risk of lateral streaks occurring, and accordingly lateral streaks do not occur. Also, the number of times of executing the cleaning mode is fewer than in Comparative Example 3-2, and accordingly deterioration of the toner 90 is suppressed after the durability test as well, and no transfer detects occurred.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-065418, filed Apr. 7, 2021, which is hereby incorporated by reference wherein in its entirety.

What is claimed is:

1. An image forming apparatus capable of executing an image forming operation of forming an image on a recording material, the image forming apparatus comprising:

an image bearing member configured to be rotatable;

a developing member configured to supply a developer that is charged to a regular polarity to a surface of the image bearing member;

a developer supply member configured to come into contact with a surface of the developing member and to supply the developer to the surface of the developing member;

a first voltage applying unit configured to apply a first voltage to the developing member;

a second voltage applying unit configured to apply a second voltage to the developer supply member; and a control unit configured to control the first voltage applying unit and the second voltage applying unit, wherein the control unit controls the image forming operation to be executed, and a rotational operation in which the developer supply member rotates in a state in which the first voltage of a same polarity as the regular polarity is applied thereto to be executed, the rotational operation including a first rotational operation in which a first potential difference is formed between the developing member and the developer supply member, and a second rotational operation in which the developing member and the developer supply member rotate in a state in which the second voltage having the same polarity as the regular polarity, and a second potential difference which is greater than the first potential difference is formed between the developing member and the developer supply member, and in a case in which a potential difference generated between the developing member and the developer supply member in the image forming operation is a third potential difference, the control unit controls a magnitude of potential difference in a direction of electrostatic force acting on developer charged to the regular polarity from the developer supply member toward the developing member, in which the first potential difference is smaller than the third potential difference, and in which the second potential difference is greater than the third potential difference.

2. The image forming apparatus according to claim 1, wherein the control unit controls the second voltage applying unit to where, in the first rotational operation, the second voltage changes to a reverse polarity direction as to the regular polarity, as compared to in the image forming operation.

3. The image forming apparatus according to claim 1, wherein the control unit controls the first voltage applying unit to where, in the first rotational operation, the first voltage changes to a direction of the regular polarity, as compared to in the image forming operation.

4. The image forming apparatus according to claim 1, wherein the control unit controls the second voltage applying unit to where, in the second rotational operation, the second voltage changes to the direction of the regular polarity, as compared to in the image forming operation.

5. The image forming apparatus according to claim 1, wherein the control unit controls the first voltage applying unit to where, in the second rotational operation, the first voltage changes to a reverse polarity direction as to the regular polarity, as compared to in the image forming operation.

6. The image forming apparatus according to claim 1, wherein the control unit reduces a developer coating amount of the developing member to a developer coating amount that is smaller than a developer coating amount in the image forming operation in the first rotational operation, by forming the first potential difference between the developing member and the developer supply member, and increases the developer coating amount of the developing member to a developer coating amount that is greater than the developer coating amount in the image forming operation in the second rotational operation, by forming the second potential difference between the developing member and the developer supply member.

7. The image forming apparatus according to claim 1, wherein the control unit rotationally drives the developing member at least two cycles or more with the developer supply member and the developing member in contact, in the first rotational operation.

8. The image forming apparatus according to claim 1, wherein the control unit rotationally drives the developing member at least one cycle or more, in the second rotational operation.

9. The image forming apparatus according to claim 1, further comprising:

charging means configured to charge the surface of the image bearing member to a predetermined surface potential; and an exposing apparatus configured to expose the charged surface of the image bearing member and form an electrostatic latent image on the surface of the image bearing member, wherein the control unit relocates a component, scraped from the surface of the developing member by the developer supply member in the first rotational operation, to the image bearing member via the developing member, by exposing the surface of the image bearing member by the exposing apparatus in the second rotational operation.

10. The image forming apparatus according to claim 9, wherein, in the second rotational operation, the exposing apparatus performs exposure on the image bearing member in which all solid printing is performed.

11. The image forming apparatus according to claim 9, wherein the component includes a component exuded from the developer supply member.

12. The image forming apparatus according to claim 11, wherein the component includes developer contaminated by a component exuded from the developer supply member.

13. The image forming apparatus according to claim 1, wherein the developing member and the developer supply member are provided in a process cartridge that is detachably mountable to a main unit of the image forming apparatus, and the control unit detects whether or not the process cartridge is new, and in a case of detection that the process cartridge is new, executes the rotational operation.

14. The image forming apparatus according to claim 1, wherein, when causing the image forming apparatus to perform the image forming operation, the control unit determines whether or not a predetermined period has elapsed from the image forming operation the last time ending, and in a case of determining that the predetermined period has elapsed, causes the image forming apparatus to perform the rotational operation.

15. The image forming apparatus according to claim 14, wherein the control unit sets an amount of time to perform the rotational operation in accordance with time from ending the image forming operation until executing the next image forming operation.

16. The image forming apparatus according to claim 15, wherein the longer the time from ending the image forming operation until executing the next image forming operation is, the longer the control unit sets the amount of time to perform the rotational operation.

17. The image forming apparatus according to claim 1, wherein the control unit causes the image forming apparatus to perform the rotational operation in accordance with an instruction from a user.

18. An image forming apparatus, comprising:

an image bearing member configured with a surface on which an electrostatic latent image is formed;

a developing member that is rotatable and that is configured to develop the electrostatic latent image on the surface of the image bearing member and form a developer image;

a developer supply member configured to supply the developer, while rotating in contact with the developing member; and a control unit, wherein the control unit controls an image forming operation in which the developer image is formed to be executed, and a cleaning mode in which a component adhering to a surface of the developing member is removed to be executed, the cleaning mode including a first rotational operation in which the component adhering to the surface of the developing member is scraped off by the developer supply member, by rotational driving of at least the developer supply member, and a second rotational operation in which the component scraped off by the developer supply member is relocated to the image bearing member by the developing member, by performing rotational driving of the developer supply member, the developing member, and the image bearing member.

19. An image forming apparatus capable of executing an image forming operation of forming an image on a recording material, the image forming apparatus comprising:

an image bearing member configured to be rotatable;

a developing member configured to supply a developer that is charged to a regular polarity to a surface of the image bearing member;

a developer supply member configured to come into contact with a surface of the developing member and to supply the developer to the surface of the developing member;

a first voltage applying unit configured to apply a first voltage to the developing member;

a second voltage applying unit configured to apply a second voltage to the developer supply member; and a control unit configured to control the first voltage applying unit and the second voltage applying unit, wherein the control unit controls the image forming operation to be executed, and a rotational operation in which the developer supply member rotates in a state in which the first voltage of a same polarity as the regular polarity is applied thereto to be executed, the rotational operation including a first rotational operation in which a first potential difference is formed between the developing member and the developer supply member, and a second rotational operation in which the developing member and the developer supply member rotate in a state in which the second voltage having the same polarity as the regular polarity and having a greater absolute value than the first voltage is applied, and a second potential difference is formed between the developing member and the developer supply member, and in a case in which a potential difference generated between the developing member and the developer supply member in the image forming operation is a third potential difference, the control unit controls a magnitude of potential difference in a direction of electrostatic force acting on developer charged to the regular polarity from the developer supply member toward the developing member, in which the first potential difference is smaller than the third potential difference, and in which the second potential difference is greater than the third potential difference.

* * * * *